US005711118A

United States Patent [19]

Molnar

[11] Patent Number: 5,711,118

[45] Date of Patent: Jan. 27, 1998

[54] METHOD OF MANUFACTURING AN ANTI-SLIP FLOORING PRODUCT AND ANTI-SLIP FLOORING ARTICLE

[75] Inventor: William S. Molnar, Detroit, Mich.

[73] Assignee: W.S. Molnar Company, Detroit, Mich.

[21] Appl. No.: 648,433

[22] Filed: May 15, 1996

[51] Int. Cl.[6] ..... E04F 11/16

[52] U.S. Cl. ..... 52/177; 52/181; 427/455; 29/459

[58] Field of Search ..... 52/177, 180, 181, 52/403.1; 427/455; 29/459, 897, 897.3, 897.32

[56] References Cited

U.S. PATENT DOCUMENTS

| | | | |
|---|---|---|---|
| 2,115,238 | 4/1938 | Stevens | 52/403.1 X |
| 3,046,852 | 7/1962 | Graham | 52/177 X |
| 3,862,464 | 1/1975 | Arens | 15/217 |
| 4,361,614 | 11/1982 | Moffitt | 428/138 |
| 4,522,009 | 6/1985 | Fingerson | 52/177 X |
| 5,009,045 | 4/1991 | Yoder | 52/177 |
| 5,054,253 | 10/1991 | Bedics | 52/177 |
| 5,338,577 | 8/1994 | Burdette, II | 427/455 X |
| 5,358,753 | 10/1994 | Rao et al. | 427/455 X |

FOREIGN PATENT DOCUMENTS

| | | | |
|---|---|---|---|
| 2275724 | 1/1976 | France | 52/177 |

OTHER PUBLICATIONS

Slip–Not (W.S. Molnar Co.)(05535/SLI–BuyLine 2280).
Slip–Not Technical Information (W.S. Molnar Co.)(05532/SLJ–BuyLine 7700).
Industries–MEBAC (IKG Industries)(W.S. Molnar Co.)
Slip–Not Grip Grate (W.S. Molnar Co..)(05532/SLI–BuyLine 577).
MEBAC Slip Resistant Surface (IKG Industries Product Data–ME–106, Aug. '91).

*Primary Examiner*—Creighton Smith
*Attorney, Agent, or Firm*—Brooks & Kushman P.C.

[57] ABSTRACT

A modular antislip flooring product for use on walking and working surfaces. A metallic plate including regions from which material is removed to reduce the rigidity of the flooring product. Reinforcements are secured about the perimeter of the metallic plate. An antislip coating is sprayed on the top surface of the plate to provide a hard rough surface. A method of making the antislip flooring product is also disclosed.

4 Claims, 1 Drawing Sheet

METHOD OF MANUFACTURING AN ANTI-SLIP FLOORING PRODUCT AND ANTI-SLIP FLOORING ARTICLE

TECHNICAL FIELD

The present invention relates to a method of making an antislip flooring product and an antislip flooring article.

BACKGROUND ART

Antislip flooring products are used in manufacturing plants on platforms, ladder steps, stairway steps and other walking and working surfaces. Antislip flooring products are also used as utility vault covers and other outdoor walking and working surfaces such as those found on oil derricks and the like. Applicant's prior patents including U.S. Pat. No. 4,618,512, U.S. Pat. No. 4,961,973, and U.S. Pat. No. 5,077,137 relate to providing an antislip surface on bar grating and metal plate used to provide walking and working surfaces.

A perceived problem associated with bar grating and solid plate is that its relative rigidity can lead to worker fatigue in applications where a worker must stand on the surface for an extended period of time. Flexible fiberglass has been used in an attempt to answer to this problem. Fiberglass grating has a reduced load bearing capacity and has the additional disadvantage of being combustible. Fiberglass grating generally has a higher cost per square foot which is further increased if an antislip coating is applied to the fiberglass grating. Fiberglass grating can have an epoxy coating containing grit applied to it to provide an antislip surface.

Metal bar grating and fiberglass grating generally include large openings between spaced bars through which foreign materials and debris can fall. Solid plate walking and working surfaces tend to block completely the passage of air, fluid and light resulting in other problems depending upon the particular application.

Other approaches to providing antislip walking and working surfaces have included the use of expanded metal sheets which are subsequently coated with an antislip metalized surface. Another approach is to provide dimple plate which has a limited antislip characteristic and is formed by punching holes in metal plates so that a jagged periphery of the hole is upstanding. This dimple plate has been used as stair treads.

Another problem with prior art platforms made of antislip material is that they tend to be large custom made structures that are typically formed in as few panels as necessary to provide platform coverage. While the large size of such platforms provide stability, such platforms are heavy and difficult to move requiring a crane or lift truck to move the platform. The above problems and others are addressed by this invention as summarized below.

SUMMARY OF THE INVENTION

According to the present invention, an antislip flooring product is provided which comprises a perforated metallic plate having reinforcements secured to the bottom of the plate and an antislip surface applied to the top of the plate.

According to another aspect of the invention, an antislip flooring article is provided by a metallic plate which has a plurality of regions from which material is removed to reduce the rigidity of the plate by locally reducing the cross-sectional area of the plate. The reduction of the cross-sectional area allows the flooring article to flex as a person walks thereon to a greater extent then if the plate did not include reasons from which material was not removed. A plurality of reinforcements are secured to the bottom side of the plate and an antislip surface is metalized over the top of the plate.

According to either of the above-described inventions, the perforations may be formed in various arrays or arrangements to modify the flexibility of the metallic plate. The perforations may be in a regular array of spaced rows and columns or in random rows. The holes may be circular or elongated and be formed by either punching, drilling, or burning through the plate. The perforations are preferably sized to prevent unwanted foreign objects from passing through the holes while permitting passage of air, fluid and light through the plate.

According to another aspect of the invention, an elastomeric member may be attached to a side of the plurality of reinforcements opposite the bottom side of the plate to resiliently support the flooring product on a supporting frame member. The elastomeric member preferably has a U-shaped cross-section so that it can fit over and grip the reinforcement to which it is attached. The concept of providing an elastomeric member on the lower side of the reinforcements for a walking and working surface member may also be practiced without including perforations or holes in the plate to which the reinforcements are attached.

According to another aspect of the invention a method of manufacturing an antislip flooring product is disclosed which comprises the steps of providing a metallic plate with a plurality of perforations. The step of providing the metallic plate with a plurality of perforations is preferably performed by utilizing a prepunched metal plate or by punching holes into a plate prior to securing reinforcements to the plate. A metallic plate is first cut to a desired shape. A plurality of reinforcements are then secured to the metallic plate preferably about its periphery. The step of securing the reinforcement of the metallic plate is preferably performed by welding the reinforcements to the bottom surface of the metallic plate. A top surface of the metallic plate is then metalized to provide an antislip surface. Metalizing is performed by arc spraying molten metal unto the top surface of the metallic plate.

According to another aspect of the invention, a modular antislip flooring product can be provided wherein relatively small rectangular flooring articles can be assembled to a framework by placing the flooring members side by side within a framework which is sized to receive a plurality of the antislip flooring products. The weight of the antislip flooring products keeps the products in place and individual members can be either replaced or removed temporarily to provide access to spaces below the framework. By making the antislip flooring product modular it can be partially disassembled or assembled without the use of cranes or lift trucks.

Elastomeric pads when provided on the reinforcements add to the resiliency of the antislip flooring product making it more comfortable to walk on. For example, in situations where workers beside an assembly line are required to stand on a section of platform for an extended period of time. The elastomeric pads provide an additional increment of resiliency and flexibility.

The perforations in the metal plate allow it to function much like grating by allowing heat, light, liquids and air to pass through without the cost burden of expensive bar grating. Also, perforations can be sized to prevent cigarettes butts from entering sumps while still allowing for drainage through the plate.

An antislip coating on the top surface of the metallic plate provides superior traction and protection for persons walking and working thereon.

These and other advantages of the present invention will be better understood in view of the attached drawings and following detailed description of the invention.

DETAILED DESCRIPTION OF INVENTION

Figure 1:
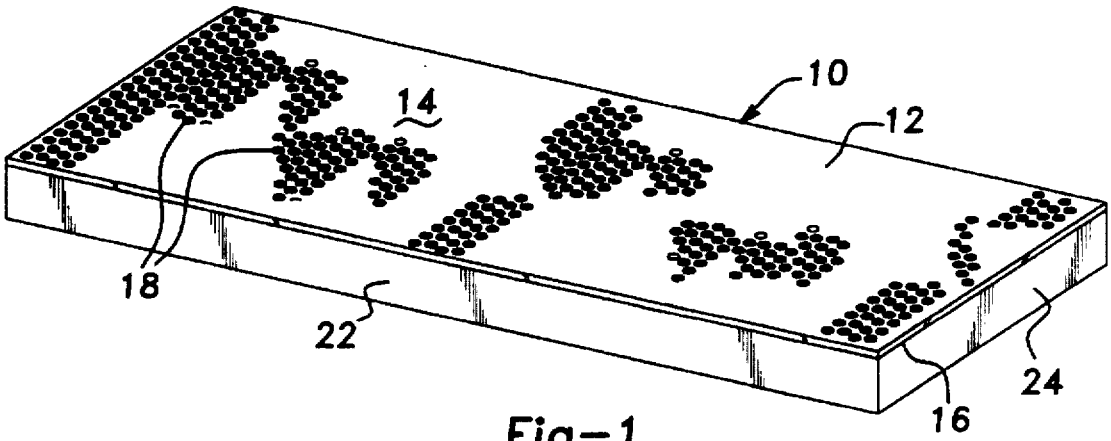
FIG. 1 is a perspective view of an antislip flooring product made according to the present invention.

Referring now to FIG. 1, an antislip flooring product 10 made according to the present invention is shown. The antislip flooring product 10 includes a plate 12 having a top side 14 and a bottom side 16. A plurality of perforations 18 are provided in the plate 12. As shown in FIG. 1, the perforations are in a series of columns and rows with each row offset relative to adjacent rows. The perforations could also be provided in a random or nonlinear arrangement.

Figure 3:
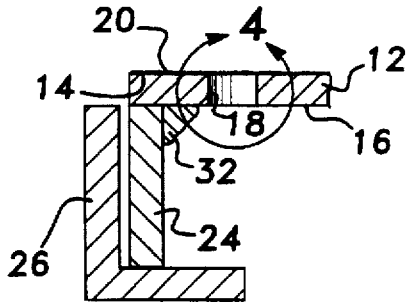
FIG. 3 is a partial cross-sectional view taken along the line 3—3 in FIG. 2.
Figure 4:
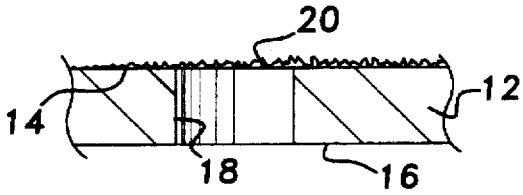
FIG. 4 is a partial cross-sectional view taken along the line 4—4 in FIG. 3.
Figure 5:
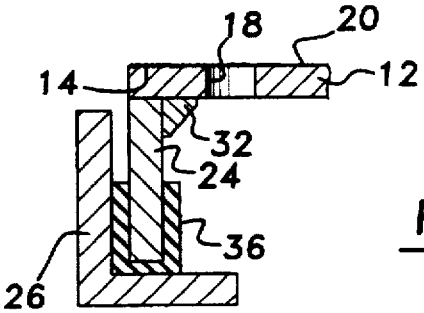
FIG. 5 is a partial cross-sectional view taken along a line similar to the view of FIG. 3 which also shows the inclusion of a U-shaped elastomeric pad on the bottom of a reinforcement to provide a resilient pad between the antislip flooring product and its supporting framework.

Referring now to FIGS. 3 through 5, an antislip coating 20 is provided on the top side 14 of the plate 12.

The antislip coating is provided in accordance with applicant's prior patents listed above. Applicant utilizes a high carbon wire to create a hard rough surface when the wire is arc sprayed. An example of a wire capable of providing a high hardness surface is wire formula FC 1362 from Cormet, Inc. of Michigan. If an aluminum antislip surface is desired, Duralcan 90/10 wire or a 5356 aluminum wire may be utilized. If the antislip surface is to receive a stainless steel antislip coating, a Ni Cr Al wire from Cormet, Inc. can be used.

Figure 2:
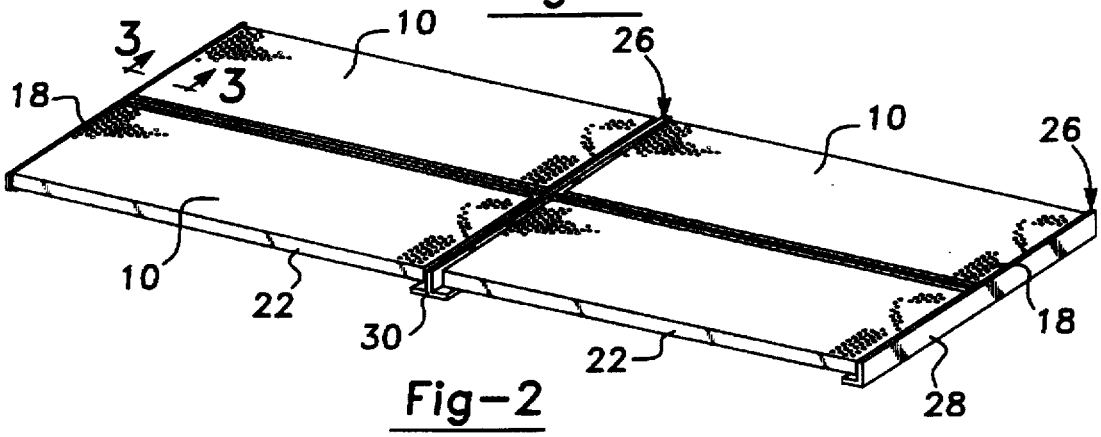
FIG. 2 is a perspective view of a plurality of antislip flooring products placed on a framework.

Referring now to FIGS. 1 and 2, longitudinal reinforcements 22 and lateral reinforcements 24 are secured to the perimeter of the plate 12 running the length and width of the plate 12. The antislip flooring product 10 of the present invention is adapted to be received within a framework 26. Once placed in the framework the antislip flooring product 10 is essentially a modular construction which can be partially disassembled to provide access or to allow the framework 26 to be moved since the individual components are considerably lighter than the entire assembly.

The framework 26 as shown in FIG. 2 is formed of angle iron sections 28 and T-shaped bars 30. The T-shaped bars 30 may be formed by securing two pieces of angle iron back to back.

Referring now to FIG. 4, the longitudinal and lateral reinforcements 22 and 24 are preferably secured to the plate 12 by means of a weld 32.

The relationship between the framework 26 and the antislip flooring products 10 can be better understood by reference to FIGS. 3 and 4. The antislip flooring product 10 rests upon the framework 26. The framework and antislip flooring products can be fastened together by welding or other fasteners, but to take advantage of the modular feature of the present invention, it would be preferred to really allow the antislip flooring product 10 to rest on the framework 26 allowing the weight of the antislip flooring product 10 to hold it in place within the confines of the framework 26. The structure of the perforations and antislip coating 20 can also be better understood by reference to FIGS. 3 and 4.

Referring now to FIG. 5, an alternative embodiment of the present invention is shown wherein the same reference numerals are used as were used in description of the embodiment of FIGS. 1 through 4. The antislip flooring product 10 further includes a U-shaped elastomeric pad which can serve to provide an additional resiliency for person walking and working on the antislip flooring product 10. The elastomeric pad 36 can also serve to provide electrical insulation and sound dampening. The other elements of the antislip flooring product 10 and its framework 26 as shown in FIG. 5 operate in the same manner as the embodiment of FIGS. 1 through 4.

While the present invention has been disclosed in connection with the description of preferred embodiments thereof, it should be understood that there may be other embodiments which fall within the spirit and scope of the invention as defined by the following claims.

What is claimed is:

1. A method of manufacturing an antislip flooring product comprising the steps of:

providing a metallic plate with a plurality of perforations;

cutting the metallic plate to a desired shape;

securing a plurality of reinforcements to the metallic plate; and metalizing a top surface of the metallic plate to provide an antislip surface.

2. The method of claim 1 wherein the step of securing the reinforcements to the metallic plate is performed by welding.

3. The method of claim 1 wherein the step of metalizing surface comprises are spraying molten metal on the top surface to form a rough surface thereon.

4. The method of claim 1 wherein the step of providing a metallic plate with a plurality of perforations is performed by punching holes in a plate prior to the step of securing reinforcements thereto.

* * * * *